US005865434A

United States Patent [19]

Yamanaka

[11] Patent Number: 5,865,434

[45] **Date of Patent: *Feb. 2, 1999**

[54] SHEET CONVEYING APPARATUS AND SHEET SORTING APPARATUS USING THE SAME

[75] Inventor: Yuji Yamanaka, Kawasaki, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 901,955

[22] Filed: Jul. 29, 1997

Related U.S. Application Data

[63] Continuation of Ser. No. 355,520, Dec. 14, 1994, abandoned.

[30] Foreign Application Priority Data

Dec. 20, 1993 [JP] Japan ..... 5-344916

[51] Int. Cl.[6] ..... B65H 39/10; B65G 15/28

[52] U.S. Cl. ..... 271/296; 198/836.2

[58] Field of Search ..... 271/288, 296, 271/297, 298, 305; 270/58; 198/836.2

[56] References Cited

U.S. PATENT DOCUMENTS

| | | | |
|---|---|---|---|
| 4,696,392 | 9/1987 | Chisholm, Jr. | 271/182 X |
| 4,822,024 | 4/1989 | Takahashi | 271/296 |
| 5,261,658 | 11/1993 | Nagai | 271/297 |
| 5,365,321 | 11/1994 | Koshimizu et al. | 198/806 X |

FOREIGN PATENT DOCUMENTS

| | | |
|---|---|---|
| 280060 | 8/1988 | European Pat. Off. . |
| 288881 | 11/1988 | European Pat. Off. . |
| 372248 | 6/1990 | European Pat. Off. . |

*Primary Examiner*—F. J. Bartuska
*Attorney, Agent, or Firm*—Fitzpatrick, Cella, Harper & Scinto

[57] ABSTRACT

A sheet conveying apparatus for feeding sheets or sheet bundles of differing thickness and a sheet sorting apparatus using the same includes a rotatable belt convey member, and a sponge roller arranged in an opposed relation to the rotatable belt convey member. Preferably, the sheet feeding apparatus further includes a shaft-to-shaft spacer for ensuring a minimum shaft-to-shaft distance between the rotatable belt convey member and the sponge roller, and a pressurizing device for urging the sponge roller and the rotatable belt convey member against each other.

22 Claims, 13 Drawing Sheets

SHEET CONVEYING APPARATUS AND SHEET SORTING APPARATUS USING THE SAME

This application is a continuation of application Ser. No. 08/355,520, filed Dec. 14, 1994, now abandoned.

BACKGROUND OF THE INVENTION

1. Field of the Invention

The present invention relates to a sheet feeding apparatus and a sheet sorting apparatus having such a sheet feeding apparatus, and more particularly, it relates to a sheet sorting apparatus which is connected to a copying machine having a reading apparatus, a facsimile machine (communication system), a printer connected to a computer, and a binding apparatus (stapler, glueing apparatus) to sort sheets or sheet bundles.

2. Related Background Art

In some conventional sheet or sheet bundle feeding apparatuses incorporated into a sheet sorting apparatus or an image forming apparatus, a thickness of a sheet bundle being fed is detected, and an upper roller is separated from a lower roller in accordance with the detected thickness so that the sheet bundle can be conveyed by the pair of upper and lower rollers.

However, in the above conventional case, since the thickness of the sheet bundle being fed must be detected and the upper roller must be separated from the lower roller in accordance with the detected thickness, the apparatus becomes very complex and expensive.

SUMMARY OF THE INVENTION

The present invention aims to eliminate the above-mentioned conventional drawback, and has an object to provide a sheet feeding apparatus and a sheet sorting apparatus having such a sheet feeding apparatus, which are simple in construction and are inexpensive.

A sheet feeding apparatus according to the present invention comprises a convey belt mounted around a plurality of rollers, and a sponge roller arranged in an opposed relation to the convey belt and capable of being deformed in accordance with a thickness of a sheet bundle. According to another aspect of the present invention, a sheet feeding apparatus comprises a shaft-to-shaft spacer for ensuring a minimum distance between a shaft of the convey belt and a shaft of the sponge roller, and a pressure spring for urging the sponge roller against the convey belt.

According to a further aspect of the present invention, there is provided a sheet sorting apparatus wherein the above-mentioned sheet feeding apparatus is used as a convey means of a lift-lower convey body, which convey means serves to convey a single sheet or sheet bundle to a tray arranged at a desired position.

In the above sheet feeding apparatus, various sheet bundles having different thicknesses can be treated by deforming the sponge roller in accordance with the thickness of the sheet bundle. Further, by using the convey belt, a convey force of A ($=\mu W$) (where, $\mu$ is coefficient of friction and W is mass of sheet bundle) can be applied to the sheet bundle at a whole area of a lower surface of the sheet bundle. Further, if the sheet bundle has a thickness greater than a predetermined value, the sponge roller can be separated from the convey belt in opposition to a biasing force of the pressure spring.

According to the sheet feeding apparatus of the present invention, by using the sponge roller and the convey belt, it is possible to provide a convey means for the sheet or sheet bundle which is simple in construction and is inexpensive. Further, according to the sheet sorting apparatus of the present invention, since the sheet feeding apparatus according to the present invention is used as the convey means of the lift/lower convey body, the mass and cost of the lift/lower convey body can be reduced.

DETAILED DESCRIPTION OF THE PREFERRED EMBODIMENTS

Figure 1:
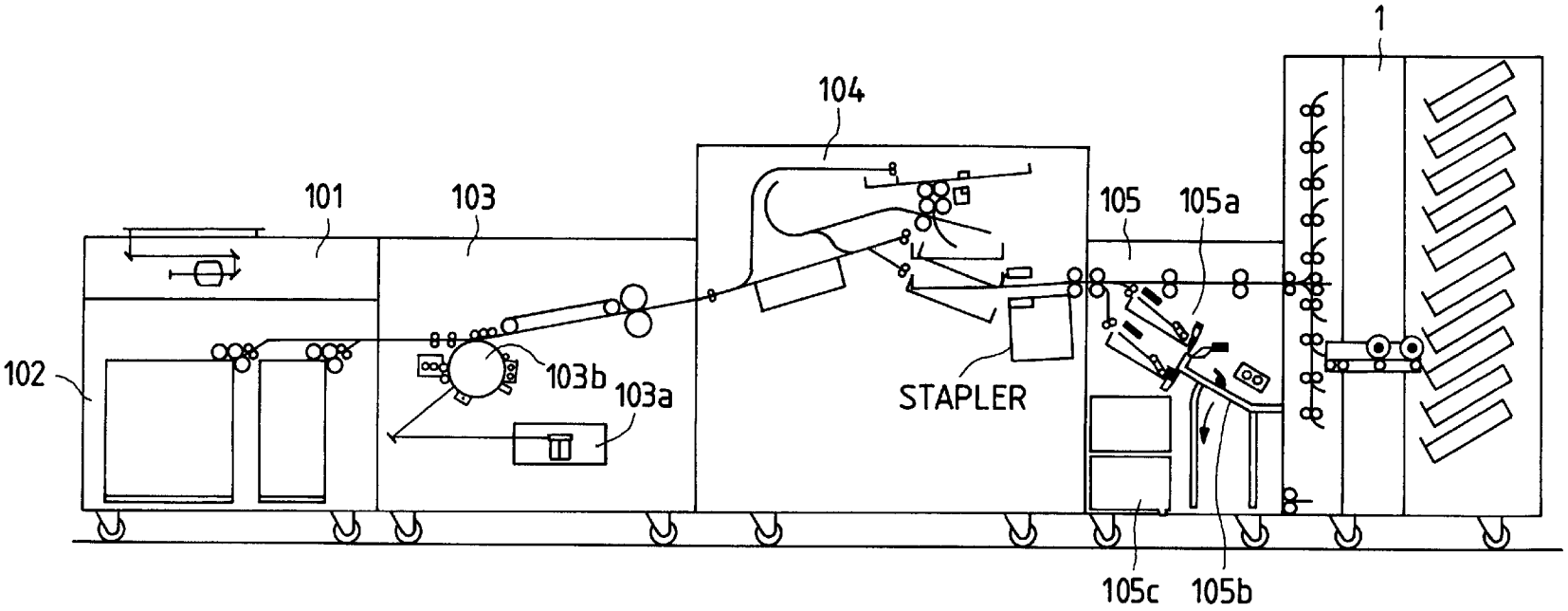
FIG. 1 is a schematic elevational sectional view of an entire system including a sheet sorting and containing apparatus according to the present invention.

The present invention will now be explained in connection with embodiments thereof with reference to the accompanying drawings. FIG. 1 is a schematic elevational sectional view of an entire system including a sheet sorting apparatus according to an embodiment of the present invention, and FIG. 2 is an elevational sectional view of the sheet sorting apparatus according to the embodiment of the present invention.

In FIG. 1, the system comprises an original reading apparatus 101 including an optical system, a sheet supply apparatus 102 including a deck, cassette and the like, and an image forming apparatus 103 including a laser scanner 103*a*, a photosensitive drum 103*b* and a binding apparatus (not shown). The laser scanner 103*a* is a writing device for writing an image on the photosensitive drum 103*b* and serves to receive an image read by the reading apparatus 101 or communication contents from a network via a memory and write the image on the photosensitive drum 103*b* by using a laser beam. The system further comprises a binding apparatus (finisher) 104 including a stapler, discharge trays and the like, and a book-binding apparatus 105 including a glueing portion 105*a*, an elevator 105*b* and discharge stackers 105*c*. A sheet sorting apparatus 1 according to the present invention is connected to the system.

Next, the sheet sorting apparatus 1 according to the illustrated embodiment will be explained with reference to FIG. 2.

Figure 2:
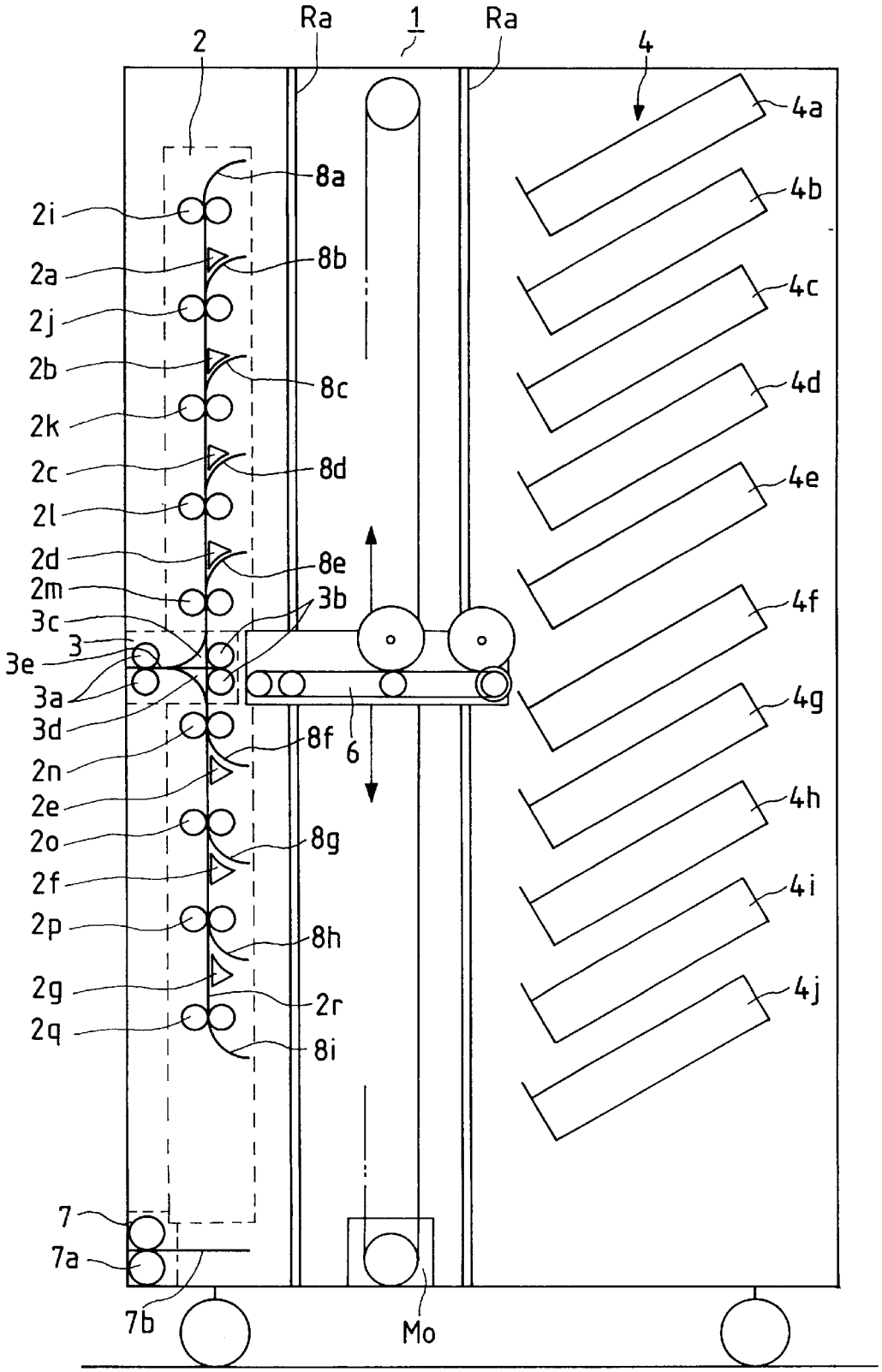
FIG. 2 is an elevational sectional view of the sheet sorting and containing apparatus according to the present invention.

In FIG. 2, the sheet sorting apparatus 1 comprises a sheet inlet portion 3 which serves to receive a single sheet or a sheet bundle (book-bound by a stapler or a glue binder) sent from the binding apparatus 104 of the system and direct the sheet or the sheet bundle to a vertical direction or a horizontal direction. To this end, the sheet inlet portion 3, there is provided a convey means for directing the single sheet or a sheet bundle having a thickness smaller than a predetermined value (about eight sheets or less) to an upward direction or a downward direction (i.e., to a convey vertical path 2 which will be described later) and for direction a sheet bundle having a thickness greater than the predetermined value (about nine sheets or more) to the horizontal direction (i.e., a lift/lower convey body 6 which will be described later). The convey means comprises a pair of inlet rollers 3*a*, a pair of outlet rollers 3*b*, and a straight path 3*e*. Further, solenoid-operated flappers 3*c*, 3*d* are provided as means for changing directions. One of the paired inlet rollers 3*a* is a drive roller;, and the other roller is a driven roller which is separated from the drive roller when the sheet bundle having the thickness greater than the predetermined value enters between the paired inlet rollers 3*a* and urges the sheet bundle against the drive roller after the sheet bundle enters between the paired inlet rollers 3*a*. Incidentally, the pair of outlet rollers 3*b* have the same construction as that of the pair of inlet rollers 3*a*.

The convey vertical path 2 is disposed at a downstream side of the sheet inlet portion 3 and serves to convey the sheet or the sheet bundle having the thickness smaller than the predetermined value branched upwardly or downwardly at the sheet inlet portion 3 toward the upward direction or downward direction. Within the convey vertical path 2, there are arranged a plurality of solenoid-operated flappers 2*a* to 2*g* in correspondence to heights of a plurality of trays 4*a* to 4*j* of a containing portion 4 as shown in FIG. 2. The flappers 2*a* to 2*g* serve to branch the sheet or the sheet bundle having the thickness smaller than the predetermined value from the convey vertical path toward the lift/lower convey body 6 which will be described later. Further, within the convey vertical path 2, there are also arranged a plurality of pairs of vertical convey rollers 2*i* to 2*q* which are arranged side by side along the vertical direction with an interval smaller than a length of smallest size sheet. Further, there are also arranged a substantially vertical convey guide 2*r* for guiding the sheet or the sheet bundle having the thickness smaller than the predetermined value, and branch paths (bent sheet guides) 8*a*–8*i* associated with the flappers 2*a*–2*g*.

The lift/lower convey body 6 is disposed at a downstream side of the branch paths 8*a*–8*i* of the convey vertical path 2 and serves to pinch and convey the sheet or the sheet bundle having the thickness smaller than the predetermined value branched at the sheet inlet portion 3 and the convey vertical path 2. Further, when the sheet bundle having the thickness smaller than the predetermined value bound at the upward binding apparatus 104 is conveyed horizontally from the sheet inlet portion 3, the lift/lower convey body 6 receives such a sheet bundle and lifts the sheet bundle to a height corresponding to a designated tray 4*a* to 4*j* via a lifter comprising a motor Mo, a chain and pulleys. Incidentally, the reference symbol Ra denotes rails for guiding the lift/lower convey body 6.

Figure 3:
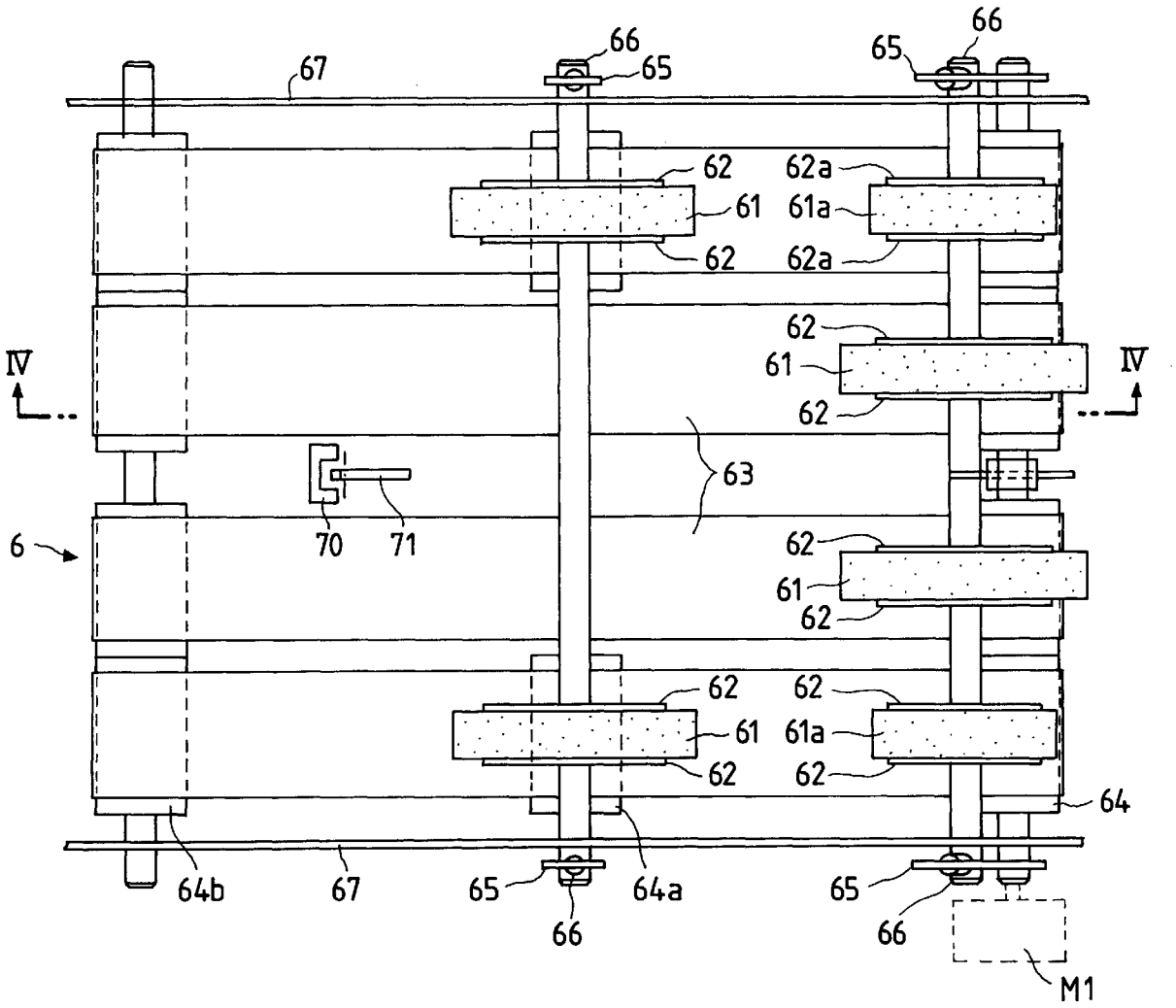
FIG. 3 is a plan view of a lift/lower convey body of the sheet sorting and containing apparatus.
Figure 4:
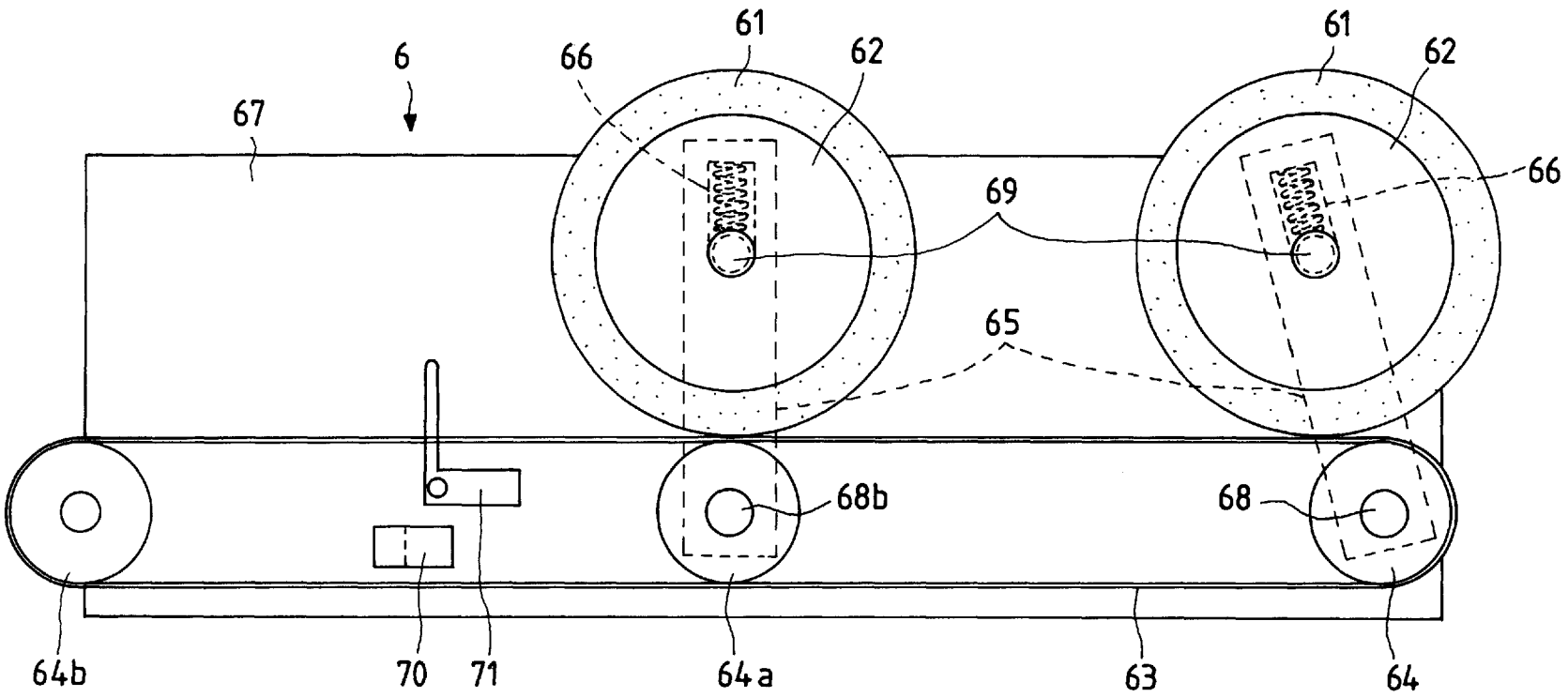
FIG. 4 is a sectional view taken along the line IV—IV in FIG. 3.

Next, the sheet feeding apparatus according to the present invention used as the convey means of the lift/lower convey body 6 will be fully explained with reference to FIGS. 3 and 4. FIG. 3 is a plan view of the lift/lower convey body 6, and FIG. 4 is a sectional view taken along the line IV—IV in FIG. 3.

A convey belt 63 is wound around two or more rollers including a drive roller 64 (in the illustrated embodiment, drive roller 64 and two driven rollers 64*a*, 64*b*). Driven sponge rollers 61 made of polyurethane foam material are arranged above the convey belt 63. The rollers 61, 64, 64*a*, 64*b* are rotatably supported by a frame 67 via shafts. The drive roller 64 is rotated by a motor Ml incorporated into the lift/lower convey body 6. It is desirable that the hardness of each sponge roller 61 is 5 to 35 kg/ 0.09 $m^2$ (when compressed by 25%), and, in the illustrated embodiment, the hardness of each sponge roller 61 was 17 kg/ 0.09 $m^2$ (when compressed by 25%). The unit is kg vs $m^2$.

Each sponge roller 61 is sandwiched by a pair of flanges 62, and the sponge roller 61 and the flanges 62 are adhered to each other through a predetermined area. In the illustrated embodiment, a diameter of the sponge roller 61 was set to 80 mm, and a diameter of flange 62 was set to 50 mm smaller than the diameter of the sponge roller by 30 mm. The reason is that elastic deformation of the sponge roller 61 is not prevented by the flanges, and the sponge roller is prevented from being laid axially by the presence of the flanges.

A shaft-to-shaft spacer 65 is arranged between a shaft 69 of the sponge roller 61 and a shaft 68 of the drive roller 64, and a similar shaft-to-shaft spacer 65 is arranged between another shaft 69 of the sponge roller 61 and a shaft 68*b* of the driven roller 64*a*, thereby ensuring a minimum value between the shafts. When the diameter of the sponge roller is D, and a distance between upper and lower surfaces of the convey belt 63 is d, the minimum value between the shafts is set to $\{(D+d)\div 2-1\}$ (mm) or less. The reason that a nip for conveying the sheet is defined between the sponge roller and the convey belt. In the illustrated embodiment, since the value was set to 80 mm and the value d was set to 30 mm, the minimum value between the shafts becomes 54 mm.

A pressure plate 66 is disposed within a slot formed in each spacer 65 is urged the corresponding sponge roller 61 downwardly. With this arrangement, although the sponge rollers 61 are set at the shaft-to-shaft minimum value position to convey the sheet, when the sheet bundle having the thickness greater than the predetermined value reaches the sponge roller, the sponge roller can be separated from the convey belt upwardly in opposition to a biasing force of the corresponding pressure spring 66.

A sensor lever 71 and a photo-sensor 70 are arranged at an upstream side of the sponge rollers 61 so that, when the sheet bundle having the thickness greater than the predetermined value is conveyed (the thickness of the sheet bundle was detected at the upstream binding apparatus and the like), the convey timing of the sheet bundle is detected by the sensor lever 71 and the photo-sensor 70, with the result that, when the sheet bundle enters into a nip between the sponge roller 61 and the convey belt 63, the convey speed of the sheet bundle is reduced, thereby preventing the impact shock of the sheet bundle. Further, since the right side (downstream side) sponge roller 61 must have not only a function for convey the single sheet or the sheet bundle but also a function for discharging the sheet or the sheet bundle onto the discharge tray of the containing portion 4, a line connecting between a center of the shaft 68 of the drive roller 64 and a center of the shaft 69 of the downstream side sponge roller 61 is inclined with respect to the vertical direction by 15 degrees, providing an upward sheet discharge angle of 15°.

Further, in the illustrated embodiment, four sponge rollers 61 are mounted on a common shaft near the discharge side, and, two of these sponge rollers have smaller diameter (60 mm). With this arrangement, the thick sheet bundle requiring a greater discharging force can be pinched and discharged by all of four sponge rollers 61. Further, when the sheet bundle enters into the nips between the sponge rollers 61 and the convey belt 63, since the sheet bundle does not strike against the small diameter sponge rollers 61*a* strongly, the impact shock of the sheet bundle against the nips can be reduced.

The containing portion 4 (refer to FIG. 4) including the plurality of trays 4*a* to 4*j* arranged side by side along the vertical direction serves to receive and contain the sheet (on which the image was formed) or the sheet bundle sent from the lift/lower convey body 6. The trays 4*a* to 4*j* can be shifted from this side to that side or vice versa (i.e., a direction perpendicular to a plane of FIG. 2), i.e., front-and-rear direction, so that the operator can draw the desired tray this side to remove the desired sheets or sheet bundles from the drawn tray. Further, each of trays 4*a* to 4*j* are inclined leftwardly downwardly so that, even when a plurality of sheets having different sizes are contained in the same tray, all of the sheets can be aligned with each other.

Next, an operation of the sheet sorting apparatus 1 having the above-mentioned construction will be explained with reference to FIGS. 5 to 9.

(In case of single sheet)

Figure 5:
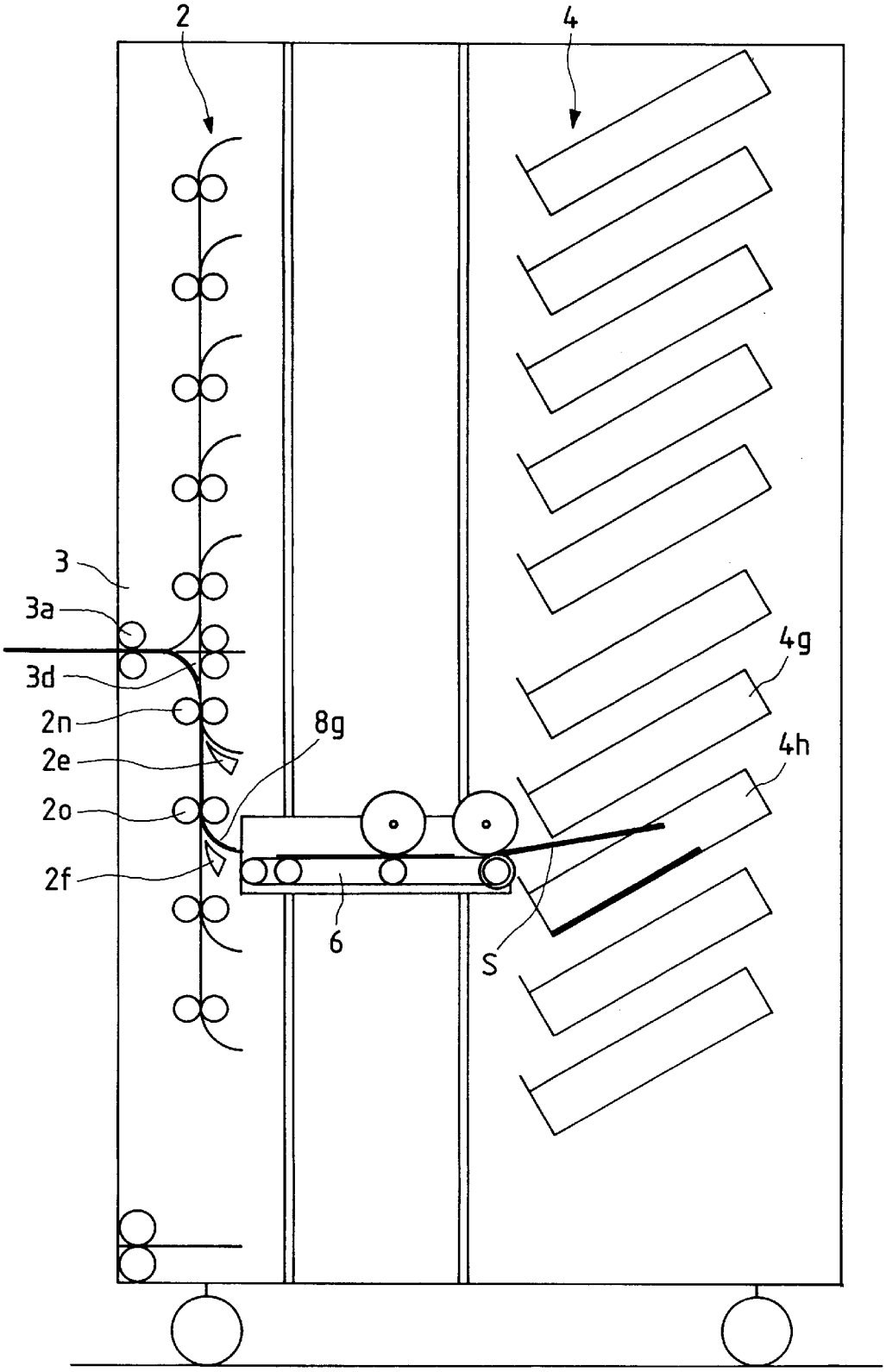
FIG. 5 is an elevational sectional view of the sheet sorting and containing apparatus in a condition that a sheet is being conveyed.

As shown in FIG. 5, when a sheet is contained in the tray 4*h* of the containing portion 4 first of all, the lift/lower convey body 6 is lowered so that it is aligned with a height position of the tray 4*h* of the containing portion 4 and is stopped there. This position is detected by a sensor. In this condition, an inlet of the lift/lower convey body 6 is aligned with the branch path 8*g*. The flapper 2*f* is switched to direct the sheet toward the branch path 8*g*. The flapper 3*d* is switched to direct the sheet toward the downward direction in the convey vertical path 2. Accordingly, the sheet S is directed to the tray 4*h* through the pair of inlet rollers 3*a*, convey vertical path 2, branch path 8*g* and lift/lower convey body 6. Similarly, when the sheet S is contained into the tray 4*g*, the lift/lower convey body 6 is shifted in correspondence to the height position of the tray 4*g* and is stopped there. Then, the flapper 2*e* of the convey vertical path 2 and the flapper 3*d* of the sheet inlet portion 3 corresponding to the stopped height of the lift/lower convey body 6 are switched, respectively.

In this way, the sheets S can be sorted in the desired trays. Incidentally, when the several sheets are bound together by the binding apparatus 104 (FIG. 1), if the number of bound sheets is few (i.e., the sheet bundle has the thickness smaller than the predetermined value), such a sheet bundle can be introduced into the desired tray in the same manner as mentioned above. (In case where large number of sheets are bound by binding apparatus 104 )

Figure 6:
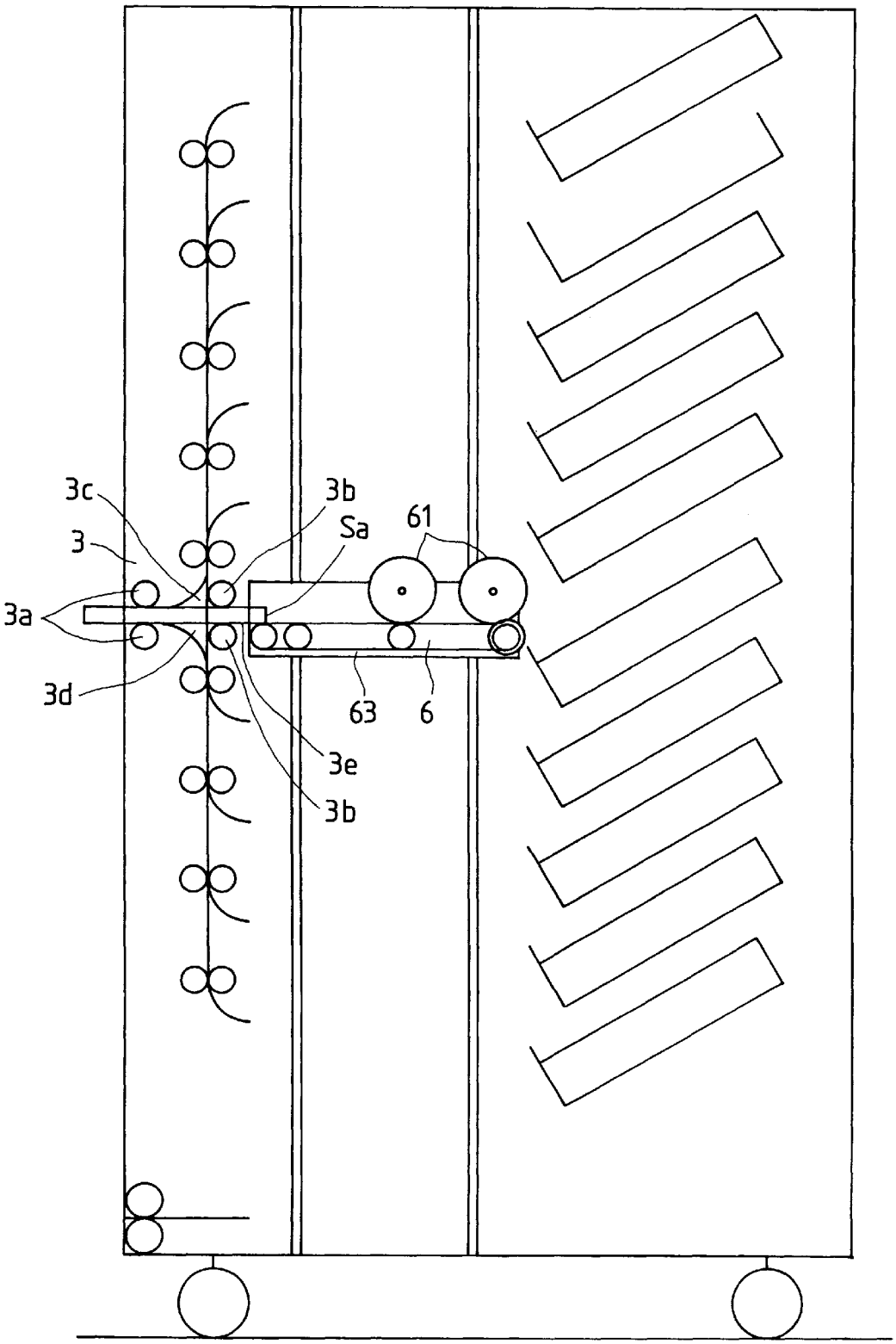
FIG. 6 is an elevational sectional view of the sheet sorting and containing apparatus in a condition that a sheet bundle is being conveyed.
Figure 7:
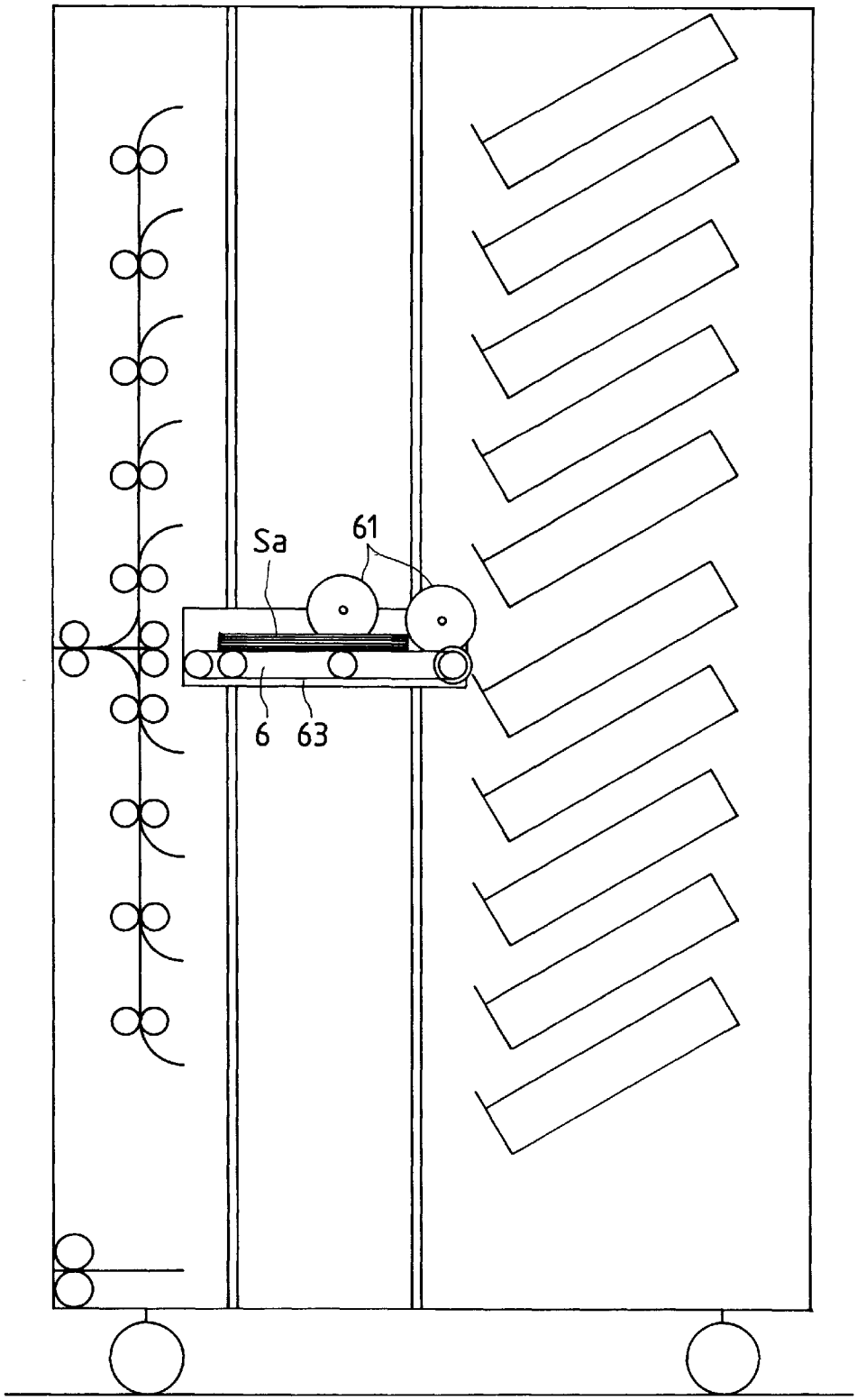
FIG. 7 is an elevational sectional view of the sheet sorting and containing apparatus, for explaining an operation following to the condition of FIG. 6.

As shown in FIG. 6, the lift/lower convey body 6 is stopped so that it is aligned with the straight path 3*e* of the sheet inlet portion 3. The flappers 3*c*, 3*d* are switched to direct the sheet bundle to the straight path 3*e*. As a result, the sheet bundle Sa is pinched between the sponge rollers 61 and the convey belt 63 of the lift/lower convey body 6, as shown in FIG. 7. The completion of the pinching is detected by detecting a tip end of the sheet bundle by means of a sensor disposed within the lift/lower convey body 6.

Figure 8:
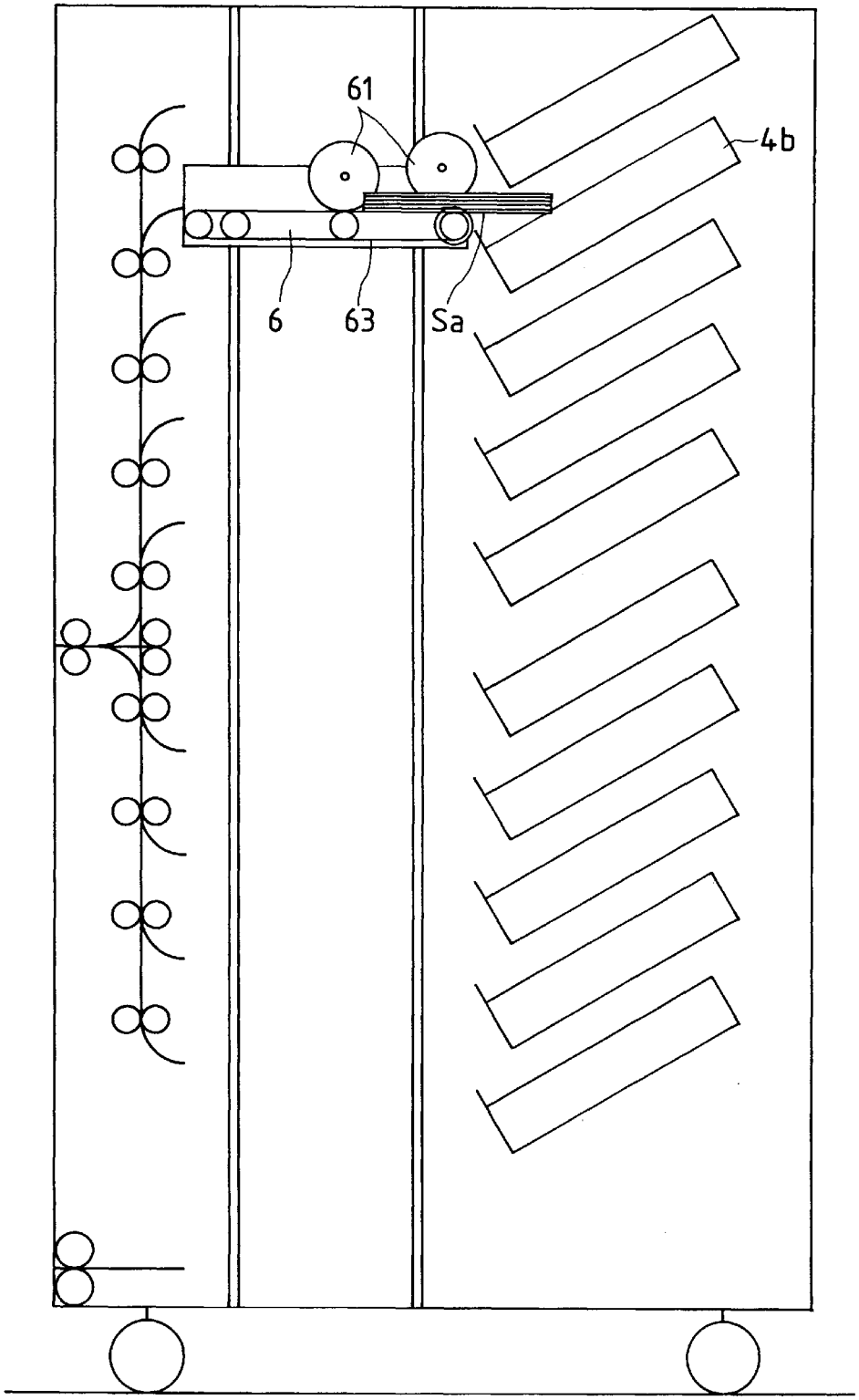
FIG. 8 is an elevational sectional view of the sheet sorting and containing apparatus, for explaining an operation following to the condition of FIG. 7.
Figure 9:
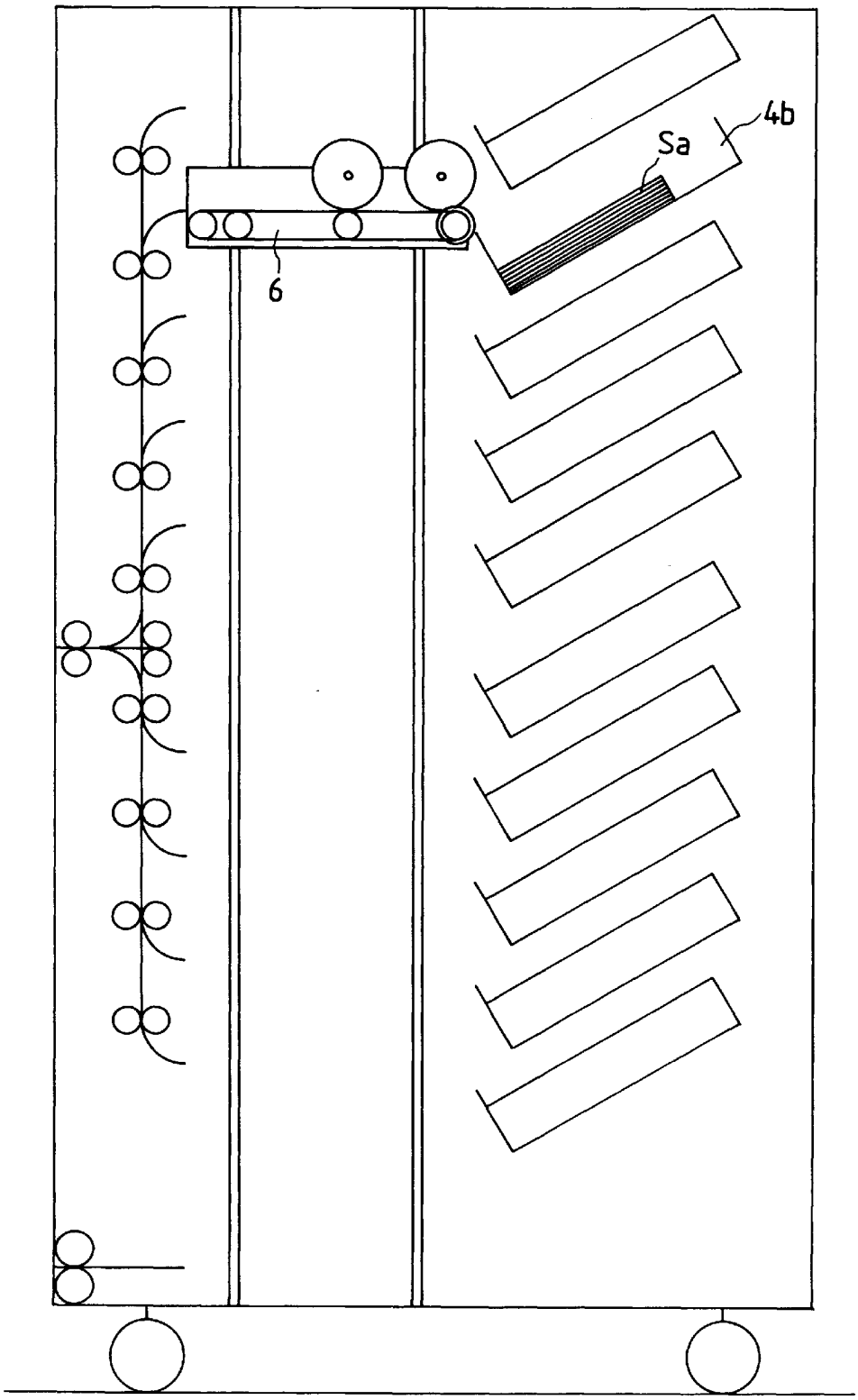
FIG. 9 is an elevational sectional view of the sheet sorting and containing apparatus, for explaining an operation following to the condition of FIG. 8.

Then, as shown in FIG. 8, the lift/lower convey body 6 is lifted in response to a pinch completion signal, so that the lift/lower convey body 6 is aligned with a height corresponding to a desired tray (for example, tray 4*b*). Then, the sponge rollers 61 and the convey belt 63 are rotated to discharge the sheet bundle Sa into the tray 4*b*. FIG. 9 shows a condition that the sheet bundle Sa has just been discharged into the tray 4*b*. The discharge of the sheet bundle is finished when predetermined seconds are elapsed after a trailing end of the sheet bundle is detected by the sensor (disposed within the lift/lower convey body).

After the discharge completion is detected, the lift/lower convey body 6 is lowered (refer to FIG. 2) and is stopped at a position where the lift/lower convey body is aligned with the straight path 3*e* for preparation for a next sheet bundle conveyance. In this way, the sheet bundles can be sorted into the desired tray or trays 4*a* to 4*j* of the containing portion 4. (In case where large number of sheets are bound by book-binding apparatus 105 ).

The sheet bundle book-bound at the glueing portion 105*a* of the book-binding apparatus 105 shown in FIG. 1 is shifted by the elevator 105*b* to be normally discharged onto a stacker 105*c*. On the other hand, when such a sheet bundle is introduced into one of the trays 4*a* to 4*j*, the elevator 105*b* is lowered to a lowermost position. At that position, the belt is rotated to shift the sheet bundle to the right. The sheet bundle shifted to the right enters between a pair of separated rollers 7*a* (FIG. 2). Thereafter, the sheet bundle is pinched between the pair of rollers 7*a* and then is shifted to the right by rotating the pair of rollers 7*a*, thereby directing the sheet bundle to a straight path 7*b*. In this case, the lift/lower convey body 6 is stopped at a position where it is aligned with the straight path 7*b*. Thus, the sheet bundle sent from the straight path 7*b* is pinched by the lift/lower convey body in the same manner as mentioned above. Thereafter, the lift/lower convey body 6 is lifted up to a height position corresponding to the desired tray, and then, the sheet bundle is discharged onto that tray.

Next, operations of the sponge rollers 61 of the lift/lower convey body 6 in the sheet bundle conveyance will be explained.

Figure 10:
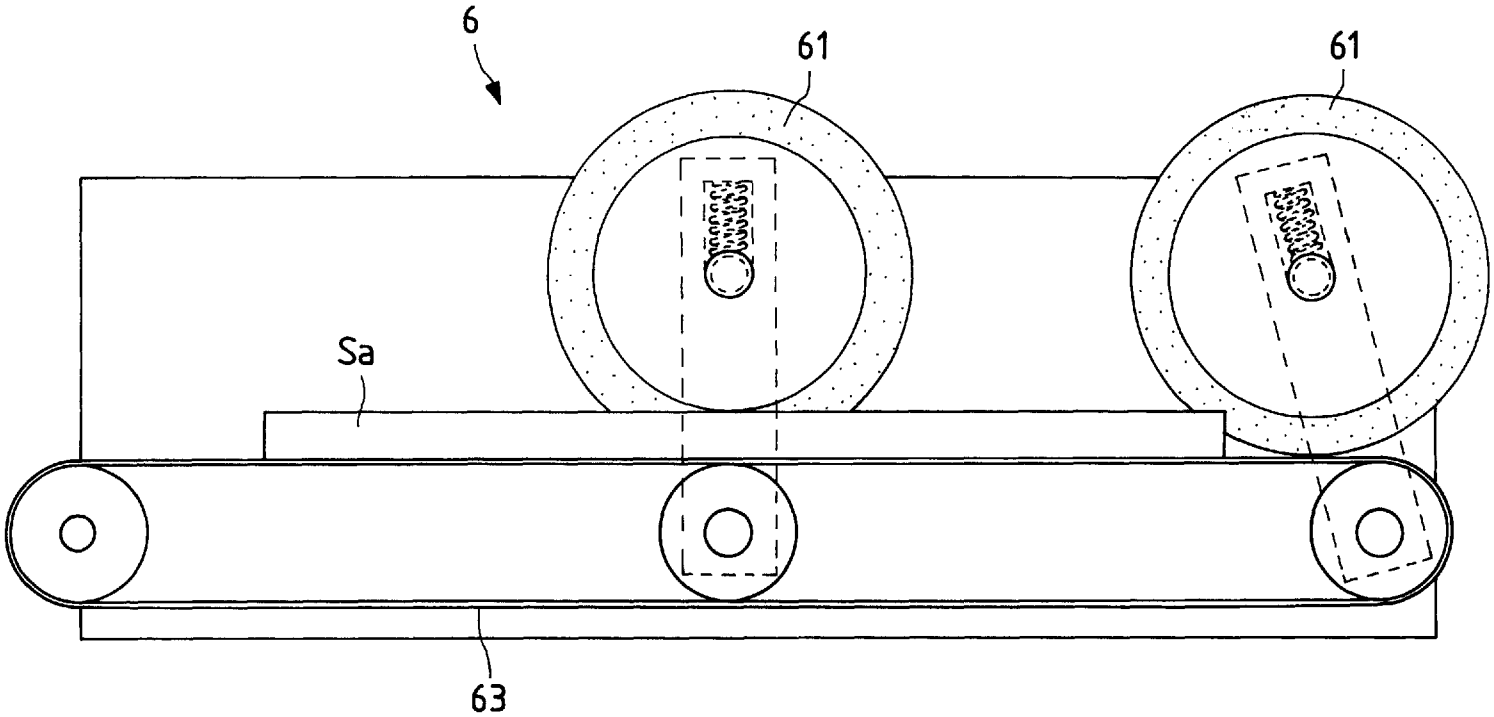
FIG. 10 is a schematic view of the lift/lower convey body of the sheet sorting and containing apparatus in a condition that a sheet bundle having a thickness smaller than a predetermined value is being conveyed.

FIG. 10 is a sectional view of the lift/lower convey body 6 in a condition that the sheet bundle having the thickness smaller than the predetermined value is conveyed. In this case, the thickness of the sheet bundle can be compensated by the deformation of the sponge rollers 61 to permit the conveyance of the sheet bundle.

Figure 11:
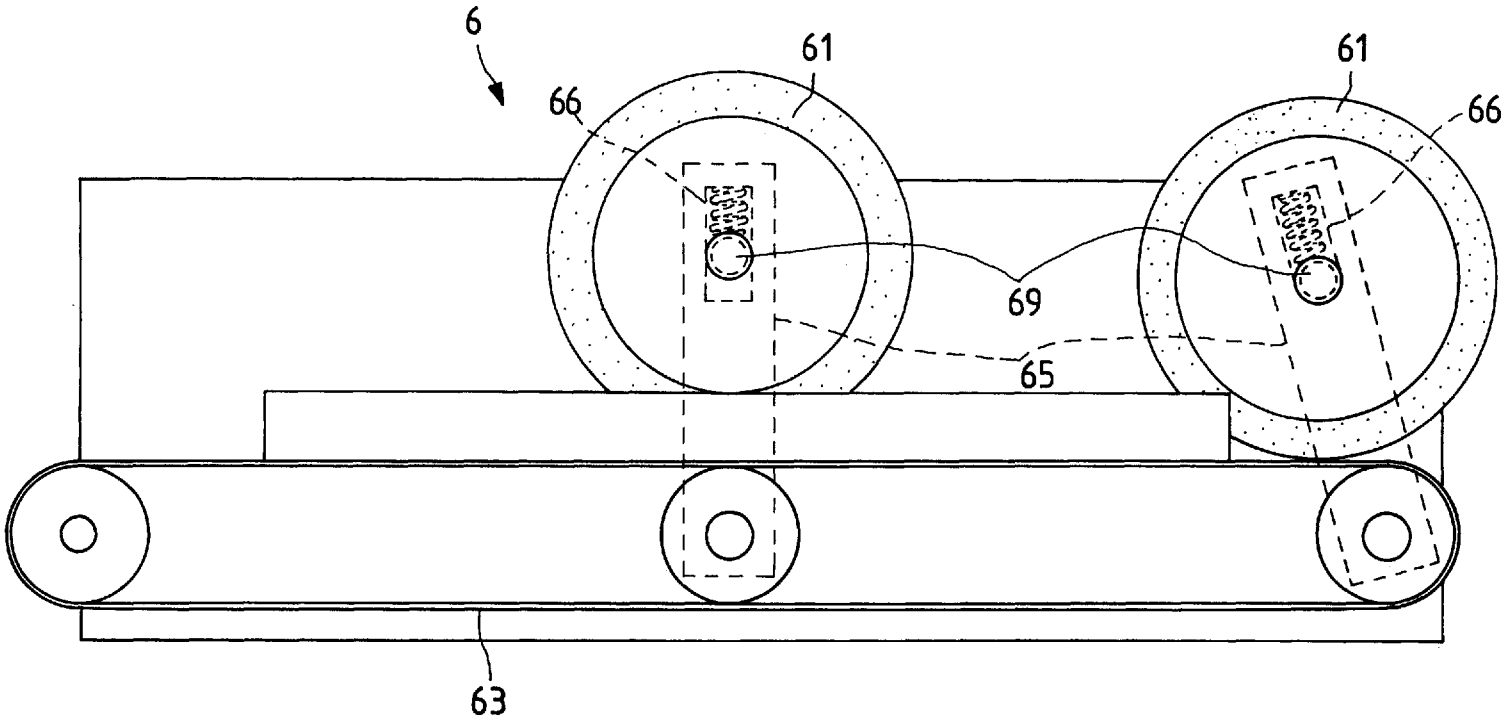
FIG. 11 is a schematic view of the lift/lower convey body of the sheet sorting and containing apparatus in a condition that a sheet bundle having a thickness greater than the predetermined value is being conveyed.

FIG. 11 is a sectional view of the lift/lower convey body 6 in a condition that the sheet bundle having the thickness greater than the predetermined value is conveyed. In this case, as shown in FIG. 11, the thickness of the sheet bundle cannot be compensated only by the deformation of the sponge rollers 61, with the result that the sponge rollers 61 (and the flanges 62 ) are pushed upwardly by the sheet bundle in opposition to the biasing forces of the pressure springs 66. That is to say, the thickness of the sheet bundle is compensated by the deformation of the sponge rollers 61 and the separation of the sponge rollers from the convey belt. The amounts of the deformation and the separation are can be adjusted by the hardness of each sponge roller 61, the number of the sponge rollers, the biasing force of each pressure spring and the shaft-to-shaft distance determined by the spacers 65.

As mentioned above, in the sheet feeding apparatus used as the convey means of the lift/lower convey body 6, by using the convey belt 63 and the sponge rollers 61, the thickness of the conveyed sheet bundle can be compensated by the deformation of the sponge rollers and the separation of the sponge rollers from the convey belt.

Figure 12A:
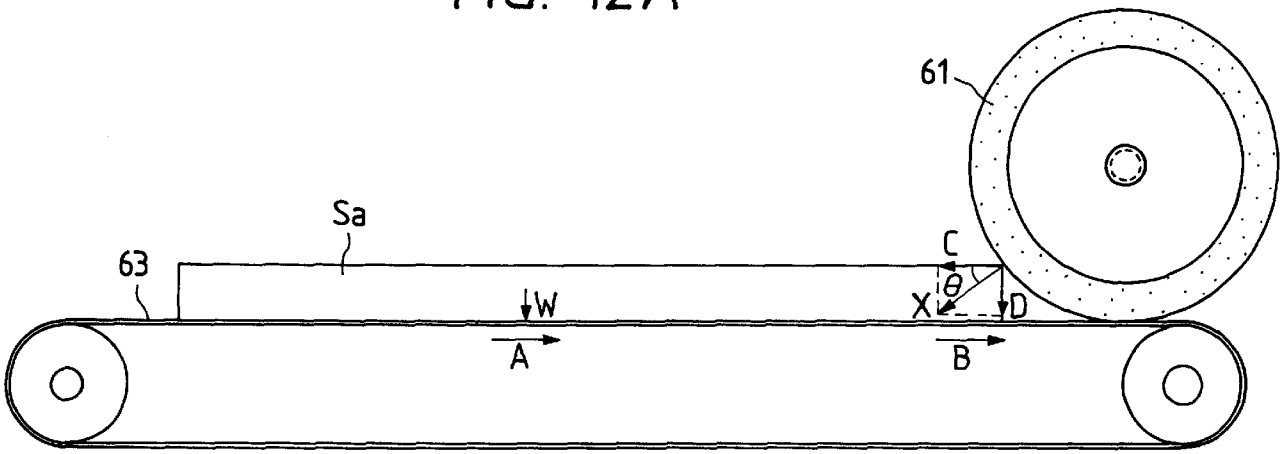
FIGS. 12A and 12B are views for explaining a conveying force of the lift/lower convey body of the sheet sorting and containing apparatus regarding the sheet bundle.

Further, it is necessary to apply the strong conveying force to the sheet bundle in order that the sponge rollers 61 are deformed by the sheet bundle. To this end, by using the convey belt 63, as shown in FIG. 12A, a conveying force A ($=\mu W$) (where, $\mu$ is coefficient of friction and W is mass of the sheet bundle) can be applied to the sheet bundle Sa through the whole area of the lower surface of the sheet bundle. Further, by the reaction force X acting from the sponge roller 61 to the sheet bundle Sa, a force C ($=\cos\theta$) for resisting to the conveyance and a force B ($=\mu D=\mu X \sin\theta$) for aiding the conveyance are generated. Thus, when it is assumed that a condition for conveying the sheet bundle adequately is B>C, since $\mu X \sin\theta > X \cos\theta$, i.e., $\mu > 1/\tan\theta$, the coefficient $\mu$ of friction may be appropriately set, and the diameter of the sponge roller 61 may be appropriately set to provide the appropriate angle $\theta$. For example, when the thickness of the sheet bundle is 10 mm, the coefficient $\mu$ of friction may be set to 1.1, and the angle $\theta$ may be set to 43 degrees.

Figure 12B:
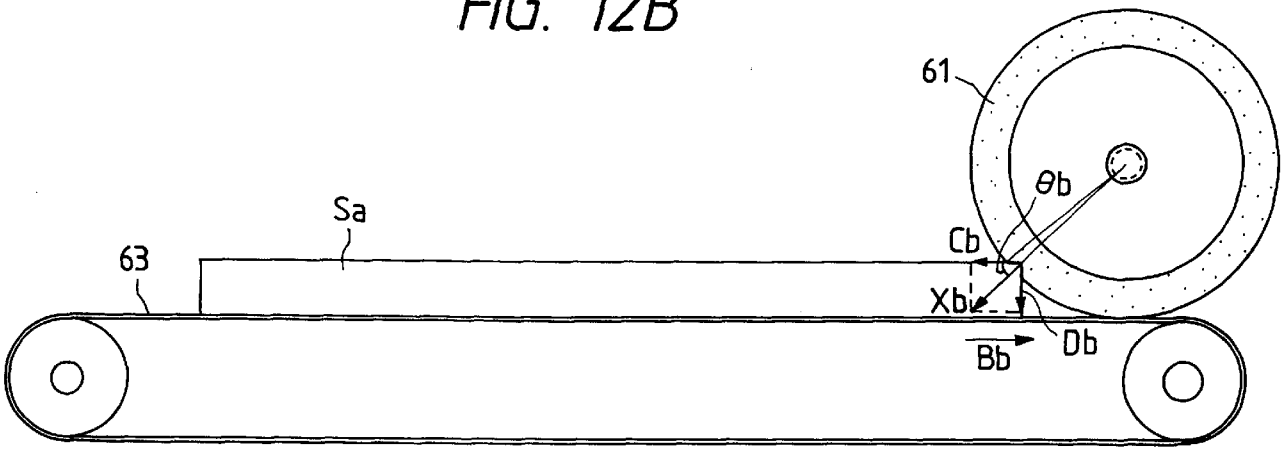
Figure 13:
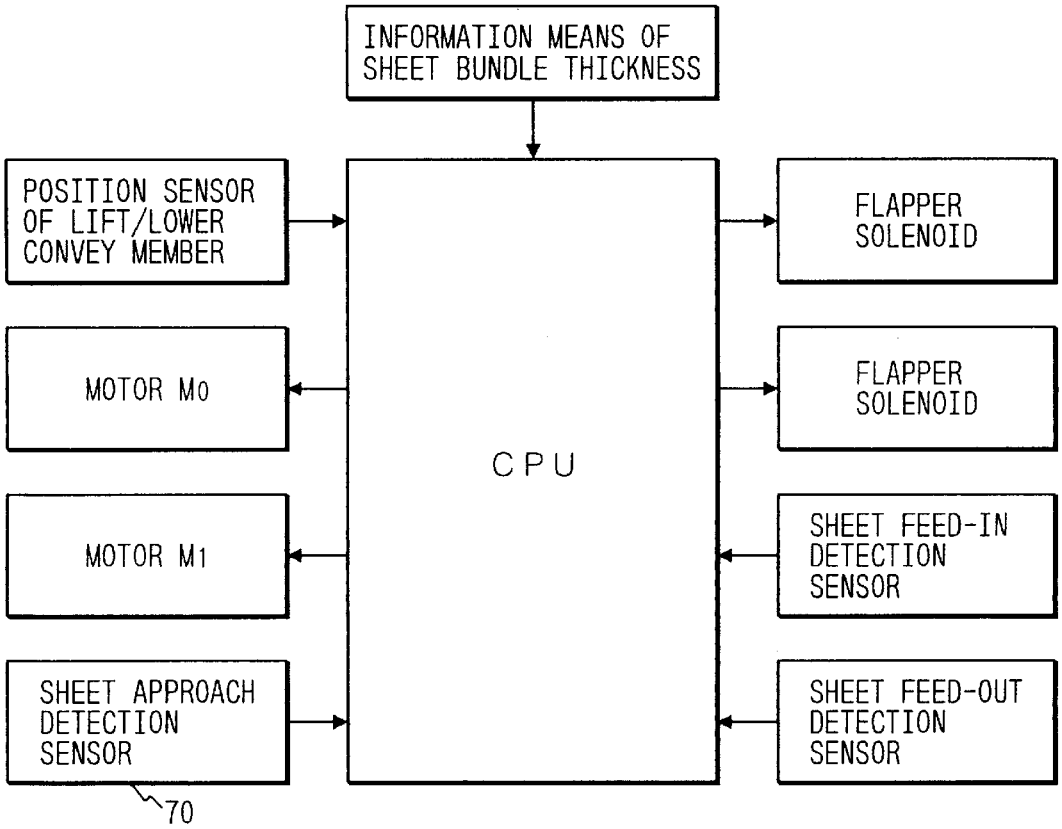
FIG. 13 is a block diagram of a control means for the sheet sorting and containing apparatus.

Even if the appropriate values of $\mu$, $\theta$ cannot be selected as shown in FIG. 12B, by utilizing the deformation of the sponge roller 61, the value of $\theta$ can be $\theta b$ greater than apparent value, with the result that the adequate conveyance can be achieved. That is to say, when $\theta<\theta b$ and $X=Xb$, conditions C>Cb and B<Bb can be obtained.

Incidentally, in a method for using the containing portion 4 the address of the trays 4*a* to 4*j* may be fixed (fixed address) or variable (floating address).

(Usage as mail box)

The trays are previously designated to individuals or parties so that, when the operator wants to distribute the copies to a certain individual or party, by selecting the tray associated with the individual or party, the copies can be contained in the designated tray. Thus, the individual or party can obtain the copies from his tray.

(Client usage)

The trays are previously designated to individuals so that the copies or bound sheet bundle(s) can be outputted to the designated tray when the individual gives the command by using a computer terminal of a net work. As a result, the erroneous output can be prevented regardless of the remote control in the net work.

(Others)

The address of the trays is not permanently designated to the individuals, but, whenever the copies are to be outputted, the operator may designate the tray or the vacant tray may be automatically selected by the image forming apparatus so that the copies can be outputted to the designated or selected tray. As a result, even if the remote controls are effected simultaneously by the plural operators under the net work, the erroneous output can be prevented.

What is claimed is:

1. A sheet feeding apparatus for feeding sheet bundles of differing thicknesses, comprising:

a rotatable belt convey member supported by and wound around a plurality of rollers;

a sponge roller arranged so as to confront one of said plurality of rollers with said belt convey member intervening therebetween;

a shaft-to-shaft spacer means engaging a shaft of said sponge roller and a shaft of said plurality of rollers for ensuring a minimum shaft-to-shaft distance between said belt convey member and said sponge roller; and pressuring means for urging said sponge roller and said belt convey member against each other.

2. A sheet feeding apparatus according to claim 1, wherein, when the sheet bundle is passed through a nip between said convey belt means and said sponge roller, a conveying speed of the sheet bundle is set to be smaller than a conveying speed of a sheet in accordance with a thickness of the sheet bundle.

3. A sheet feeding apparatus according to claim 1, wherein said sponge roller is sandwiched by flanges having diameters smaller than a diameter of said sponge roller.

4. A sheet feeding apparatus according to claim 1, wherein, when a diameter of said sponge roller is D and a diameter of said roller of said convey belt member is d, the minimum shaft-to-shaft distance ensured by said spacer means is set to be $\{(D+d) \div 2-1\}$ (mm) or less.

5. A sheet feeding apparatus according to claim 1, wherein said sponge roller comprises a plurality of sponge rollers disposed at an upstream area and a downstream area of said belt convey member so that each said area confronts a different one of said plurality of rollers.

6. A sheet sorting apparatus comprising:

a sheet inlet portion;

a containing portion arranged downstream of said sheet inlet portion and having a plurality of trays disposed in a vertical direction; and a lift/lower convey body provided with a sheet feeding apparatus for feeding a sheet, said lift/lower convey body including a substantially horizontal rotatable belt convey member on which the sheet introduced from said inlet portion is mounted and a sponge roller arranged above said rotatable belt convey member to be opposed thereto, said lift/lower convey body being arranged between said sheet inlet portion and said containing portion to be lifted and lowered in a vertical direction while keeping the sheet in a substantially horizontal posture, for conveying the sheet received on said belt convey member to a designated tray.

7. A sheet sorting apparatus according to claim 6, wherein four or more sponge rollers are provided on a side of said lift/lower convey body near said containing portion, and two or more of these sponge rollers have diameters smaller than those of the other sponge rollers.

8. A sheet sorting apparatus according to claim 6, wherein said sponge rollers are arranged at an upstream side and a downstream side, and the downstream side sponge rollers are designed so that the sheet can be discharged upwardly.

9. A sheet feeding apparatus according to claim 6, further comprising:

a shaft-to-shaft spacer means for ensuring a minimum shaft-to-shaft distance between said rotatable belt convey member and said sponge roller; and a pressurizing means for urging said sponge roller and said rotatable belt convey member against each other.

10. A sheet feeding apparatus according to claim 9, wherein, when the sheet bundle is passed through a nip between said convey belt means and said sponge roller, a convey speed of the sheet bundle is set to be slower than a conveying speed of a sheet in accordance with a thickness of the sheet bundle.

11. A sheet feeding apparatus according to claim 9, wherein said sponge roller is sandwiched by flanges having diameters smaller than a diameter of said sponge roller.

12. A sheet feeding apparatus according to claim 9, wherein, when a diameter of said sponge roller is D and a distance between upper and lower surface of said convey belt member is d, the minimum shaft-to-shaft distance ensured by said spacer means is set to be $\{(D+d) \div 2-1\}$ (mm) or less.

13. A sheet sorting apparatus according to claim 6, wherein the rotatable belt convey member is supported by and wound around a plurality of rollers, and wherein said sponge roller is arranged so as to confront one of said plurality of rollers with said belt coney member intervening therebetween;

and further comprising:

a shaft-to-shaft spacer means engaging a shaft of said sponger roller and a shaft of said plurality of rollers for ensuring a minimum shaft-to-shaft distance between said belt convey member and said sponge roller; and pressuring means for urging said sponge roller and said belt convey member against each other.

14. A sheet feeding apparatus for feeding a sheet, comprising:

a rotatable belt convey member supported by and wounded around a plurality of rollers;

a sponge roller arranged so as to confront one of said plurality of rollers with said rotatable belt convey member intervening therebetween;

a shaft-to-shaft spacer means engaging with a shaft of said sponge roller and a shaft of said plurality of rollers for ensuring a minimum shaft-to-shaft distance between said rotatable belt convey member and said sponge roller; and a pressurizing means for urging said sponge roller and said rotatable belt convey member against each other.

15. A sheet feeding apparatus according to claim 14, wherein, when the sheet bundle is passed through a nip between said convey belt means and said sponge roller, a conveying speed of the sheet bundle is set to be smaller than a conveying speed of a sheet in accordance with a thickness of the sheet bundle.

16. A sheet feeding apparatus according to claim 14, wherein said sponge roller is sandwiched by flanges having diameters smaller than a diameter of said sponge roller.

17. A sheet feeding apparatus according to claim 14, wherein said sponge roller comprises a plurality of sponge rollers disposed at an upstream area and a downstream area of said belt convey member so that each said area confronts a different one of said plurality of rollers.

18. A sheet sorting apparatus comprising:

a sheet feeding apparatus for feeding a sheet including a rotatable belt convey member, a sponge roller arranged in an opposing relationship with said rotatable belt convey member, a shaft-to-shaft spacer means for ensuring a minimum shaft-to-shaft distance between said rotatable belt convey member and said sponge roller, and a pressurizing means for urging said sponge roller and said rotatable belt convey member against each other;

a sheet inlet portion;

a containing portion arranged downstream of said sheet inlet portion and having a plurality of trays; and a lift/lower convey body arranged between said sheet inlet portion and said containing portion to be lifted or lowered for conveying a received sheet to a designated tray;

wherein said sheet feeding apparatus is used in said lift/lower convey body.

19. A sheet sorting apparatus according to claim 18, wherein four or more sponge rollers are provided on a side of said lift/lower convey body near said containing portion, and two or more of these sponge rollers have diameters smaller than those of the other sponge rollers.

20. A sheet sorting apparatus according to claim 19, wherein said sponge rollers are arranged at an upstream side and a downstream side, and the downstream side sponge rollers are designed so that the sheet can be discharged upwardly.

21. A sheet feeding apparatus according to claim 10, wherein, when the sheet bundle is passed through a nip between said convey belt means and said sponge roller, a conveying speed of the sheet bundle is set to be slower than a conveying speed of a sheet in accordance with a thickness of the sheet bundle.

22. A sheet feeding apparatus according to claim 18, wherein said sponge roller is sandwiched by flanges having diameters smaller than a diameter of said sponge roller.

* * * * *

UNITED STATES PATENT AND TRADEMARK OFFICE

CERTIFICATE OF CORRECTION

PATENT NO. : 5,865,434
DATED : February 2, 1999
INVENTOR(S) : Yuji Yamanaka

It is certified that error appears in the above-identified patent and that said Letters Patent is hereby corrected as shown below:

Column 3,
Line 23, "direction" should read -- directing --; and
Line 47, "portion 4" should read -- portion 4, --.

Column 4,
Line 50, "is urged" should read -- urges --.

Column 5,
Line 3, "convey" should read -- conveying --; and
Line 40, "portion 4" should read -- portion 4, --.

Column 6,
Line 66, "are" should be deleted.

Column 7,
Line 35, "4 the" should read -- 4, the --.

Column 8,
Line 52, "feeding" should read -- sorting --;
Line 59, "feeding" should read -- sorting --; and
Line 65, "feeding" should read -- sorting --.

Column 9,
Line 1, "feeding" should read -- sorting --;
Line 11, "coney" should read -- convey --; and
Line 15, "sponger" should read -- sponge --.

Column 10,
Line 36, "feeding" should read -- sorting --, and "claim 10," should read -- claim 18, --; and
Line 41, "feeding" should read -- sorting --.

UNITED STATES PATENT AND TRADEMARK OFFICE

CERTIFICATE OF CORRECTION

PATENT NO. : 5,865,434
DATED : February 2, 1999
INVENTOR(S) : Yuji Yamanaka

It is certified that error appears in the above-identified patent and that said Letters Patent is hereby corrected as shown below:

Column 9,
Line 1, "feeding" should read -- sorting --;
Line 11, "coney" should read -- convey --; and
Line 15, "sponger" should read -- sponge --.

Column 10,
Line 36, "feeding" should read -- sorting --, and "claim 10," should read -- claim 18, --; and
Line 41, "feeding" should read -- sorting --.

Signed and Sealed this

Twenty-first Day of August, 2001

*Attest:*

Nicholas P. Godici

*Attesting Officer*

NICHOLAS P. GODICI
*Acting Director of the United States Patent and Trademark Office*